US011508284B2

(12) United States Patent
Yang et al.

(10) Patent No.: US 11,508,284 B2
(45) Date of Patent: Nov. 22, 2022

(54) GRAYSCALE COMPENSATION METHOD AND APPARATUS, DISPLAY DEVICE

(71) Applicant: Xiamen Tianma Micro-Electronics Co., Ltd., Xiamen (CN)

(72) Inventors: Yang Yang, Shanghai (CN); Bojia Lv, Shanghai (CN); Xiangzi Kong, Shanghai (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 227 days.

(21) Appl. No.: 16/916,162

(22) Filed: Jun. 30, 2020

(65) Prior Publication Data

US 2020/0335028 A1 Oct. 22, 2020

(30) Foreign Application Priority Data

Dec. 31, 2019 (CN) ..... 201911426335.9

(51) Int. Cl.
*G09G 3/00* (2006.01)
*G09G 3/20* (2006.01)

(52) U.S. Cl.
CPC ..... *G09G 3/2018* (2013.01); *G09G 3/2074* (2013.01)

(58) Field of Classification Search
None
See application file for complete search history.

(56) References Cited

U.S. PATENT DOCUMENTS

2019/0114971 A1* 4/2019 Choi ..... G09G 3/2014
2021/0166627 A1* 6/2021 Xiao ..... G09G 3/3266

FOREIGN PATENT DOCUMENTS

CN 107204170 A 9/2017
CN 108962135 A 12/2018
CN 109377945 A 2/2019
CN 110299104 A 10/2019

* cited by examiner

*Primary Examiner* — Michael A Faragalla
(74) *Attorney, Agent, or Firm* — Kilpatrick Townsend & Stockton, LLP

(57) ABSTRACT

Disclosed are a grayscale compensation method and apparatus, and a display device. The grayscale compensation method includes obtaining a basic grayscale of each compensation device; obtaining an equivalent lighting duration of the each compensation device, where the equivalent lighting duration is a duration of lighting the compensation device with a preset grayscale obtained by converting an actual lighting duration of the compensation device; if the equivalent duration reaches a preset time point, obtaining a grayscale compensation parameter corresponding to the compensation device by searching a table according to the preset time point and the basic grayscale, and performing grayscale compensation on a sub-pixel in the compensation device according to the grayscale compensation parameter and the basic grayscale.

19 Claims, 12 Drawing Sheets

| | T1 | T2 | T3 | T4 | T5 | … | Tn-1 | Tn |
|---|---|---|---|---|---|---|---|---|
| H255 | Q1255 | Q2255 | Q3255 | Q4255 | Q5255 | … | Q(n-1)255 | Qn255 |
| H254 | Q1254 | Q2254 | Q3254 | Q4254 | Q5254 | … | Q(n-1)254 | Qn254 |
| H253 | Q1253 | Q2253 | Q3253 | Q4253 | Q5253 | … | Q(n-1)253 | Qn253 |
| H252 | Q1252 | Q2252 | Q3252 | Q4252 | Q5252 | … | Q(n-1)252 | Qn252 |
| … | … | … | … | … | … | … | … | … |
| H2 | Q12 | Q22 | Q32 | Q42 | Q52 | … | Q(n-1)2 | Qn2 |
| H1 | Q11 | Q21 | Q31 | Q41 | Q51 | … | Q(n-1)1 | Qn1 |
| H0 | Q10 | Q20 | Q30 | Q40 | Q50 | … | Q(n-1)0 | Qn0 |

FIG. 4

| | T1 | T2 | T3 | T4 | T5 | … | Tn-1 | Tn |
|---|---|---|---|---|---|---|---|---|
| R255 | Q1255 | Q2255 | Q3255 | Q4255 | Q5255 | … | Q(n-1)255 | Qn255 |
| R254 | Q1254 | Q2254 | Q3254 | Q4254 | Q5254 | … | Q(n-1)254 | Qn254 |
| R253 | Q1253 | Q2253 | Q3253 | Q4253 | Q5253 | … | Q(n-1)253 | Qn253 |
| R252 | Q1252 | Q2252 | Q3252 | Q4252 | Q5252 | … | Q(n-1)252 | Qn252 |
| … | … | … | … | … | … | … | … | … |
| R2 | Q12 | Q22 | Q32 | Q42 | Q52 | … | Q(n-1)2 | Qn2 |
| R1 | Q11 | Q21 | Q31 | Q41 | Q51 | … | Q(n-1)1 | Qn1 |
| R0 | Q10 | Q20 | Q30 | Q40 | Q50 | … | Q(n-1)0 | Qn0 |

FIG. 5

| | T1 | T2 | T3 | T4 | T5 | … | Tn-1 | Tn |
|---|---|---|---|---|---|---|---|---|
| G255 | Q1255 | Q2255 | Q3255 | Q4255 | Q5255 | … | Q(n-1)255 | Qn255 |
| G254 | Q1254 | Q2254 | Q3254 | Q4254 | Q5254 | … | Q(n-1)254 | Qn254 |
| G253 | Q1253 | Q2253 | Q3253 | Q4253 | Q5253 | … | Q(n-1)253 | Qn253 |
| G252 | Q1252 | Q2252 | Q3252 | Q4252 | Q5252 | … | Q(n-1)252 | Qn252 |
| … | … | … | … | … | … | … | … | … |
| G2 | Q12 | Q22 | Q32 | Q42 | Q52 | … | Q(n-1)2 | Qn2 |
| G1 | Q11 | Q21 | Q31 | Q41 | Q51 | … | Q(n-1)1 | Qn1 |
| G0 | Q10 | Q20 | Q30 | Q40 | Q50 | … | Q(n-1)0 | Qn0 |

FIG. 6

| | T1 | T2 | T3 | T4 | T5 | … | Tn-1 | Tn |
|---|---|---|---|---|---|---|---|---|
| B255 | Q1255 | Q2255 | Q3255 | Q4255 | Q5255 | … | Q(n-1)255 | Qn255 |
| B254 | Q1254 | Q2254 | Q3254 | Q4254 | Q5254 | … | Q(n-1)254 | Qn254 |
| B253 | Q1253 | Q2253 | Q3253 | Q4253 | Q5253 | … | Q(n-1)253 | Qn253 |
| B252 | Q1252 | Q2252 | Q3252 | Q4252 | Q5252 | … | Q(n-1)252 | Qn252 |
| … | … | … | … | … | … | … | … | … |
| B2 | Q12 | Q22 | Q32 | Q42 | Q52 | … | Q(n-1)2 | Qn2 |
| B1 | Q11 | Q21 | Q31 | Q41 | Q51 | … | Q(n-1)1 | Qn1 |
| B0 | Q10 | Q20 | Q30 | Q40 | Q50 | … | Q(n-1)0 | Qn0 |

FIG. 7

GRAYSCALE COMPENSATION METHOD AND APPARATUS, DISPLAY DEVICE

CROSS-REFERENCE TO RELATED APPLICATIONS

This application claims priority to Chinese patent application No. CN 201911426335.9 filed with CNIPA on Dec. 31, 2019, the disclosure of which is incorporated herein by reference in its entirety.

FIELD

The present disclosure relates to the field of display technologies, and particularly to a grayscale compensation method and apparatus, and a display device.

BACKGROUND

Organic light-emitting display panels have the advantages of self-lighting, no backlight, low power consumption, and high brightness, and are widely used in various electronic devices and are favored by users.

With the continuous increase of the total display duration, the thin-film transistor threshold voltage drift and the aging of light-emitting elements will occur in the organic light-emitting display panel. The application of the organic light-emitting display panel in vehicles and industrial equipment with long life is thus limited. In the related art, a compensation technology is used, which is timing compensation technology in most cases. However, the timing compensation technology in the related art is complicated and difficult to implement.

SUMMARY

The present disclosure provides a grayscale compensation method and apparatus, and a display device to simplify the process of implementing pixel grayscale compensation by using a timing compensation method.

One embodiment of the present disclosure provides a grayscale compensation method, and the method includes following steps.

A basic grayscale of each compensation device is obtained.

An equivalent lighting duration of the each compensation device is obtained, where the equivalent lighting duration is a duration of lighting the compensation device with a preset grayscale obtained by converting an actual lighting duration of the compensation device.

If the equivalent duration reaches a preset time point, a grayscale compensation parameter corresponding to the compensation device is obtained by searching a table according to the preset time point and the basic grayscale, and grayscale compensation is performed on a sub-pixel in the compensation device according to the grayscale compensation parameter and the basic grayscale.

The compensation device includes one sub-pixel, and the basic grayscale is a current grayscale of the sub-pixel.

Or the compensation device includes multiple sub-pixels with a same light-emitting color in a preset partition, and the basic grayscale is an average value of current grayscales of multiple sub-pixels with the same light-emitting color.

One embodiment of the present disclosure provides a grayscale compensation apparatus, and the apparatus includes a grayscale obtaining device, a duration obtaining device, a parameter searching device and a compensation device.

The grayscale obtaining device is configured to obtain a basic grayscale of each compensation device.

The duration obtaining device is configured to obtain an equivalent lighting duration of the each compensation device, where the equivalent lighting duration is a duration of lighting the compensation device with a preset grayscale obtained by converting an actual lighting duration of the compensation device.

The parameter searching device is configured to, in response to determining that the equivalent duration reaches a preset time point, obtain a grayscale compensation parameter corresponding to the compensation device by searching a table according to the preset time point and the basic grayscale.

The compensation device is configured to perform grayscale compensation on a sub-pixel in the compensation device according to the grayscale compensation parameter and the basic grayscale.

The compensation device includes one sub-pixel, and the basic grayscale is a current grayscale of the sub-pixel.

Or the compensation device includes multiple sub-pixels with a same light-emitting color in a preset partition, and the basic grayscale is an average value of current grayscales of the multiple sub-pixels with the same light-emitting color.

One embodiment of the present disclosure further provides a display device, including the grayscale compensation apparatus according to other embodiments.

BRIEF DESCRIPTION OF DRAWINGS

Embodiments of the present disclosure will become more apparent by reading the detailed description of the non-limiting embodiments with reference to the following drawings.

FIG. 4 is a schematic diagram of a compensation data table according to an embodiment of the present disclosure;

FIG. 5 is a schematic diagram of another compensation data table according to an embodiment of the present disclosure;

FIG. 6 is a schematic diagram of another compensation data table according to an embodiment of the present disclosure;

FIG. 7 is a schematic diagram of another compensation data table according to an embodiment of the present disclosure;

DETAILED DESCRIPTION

Figure 1:
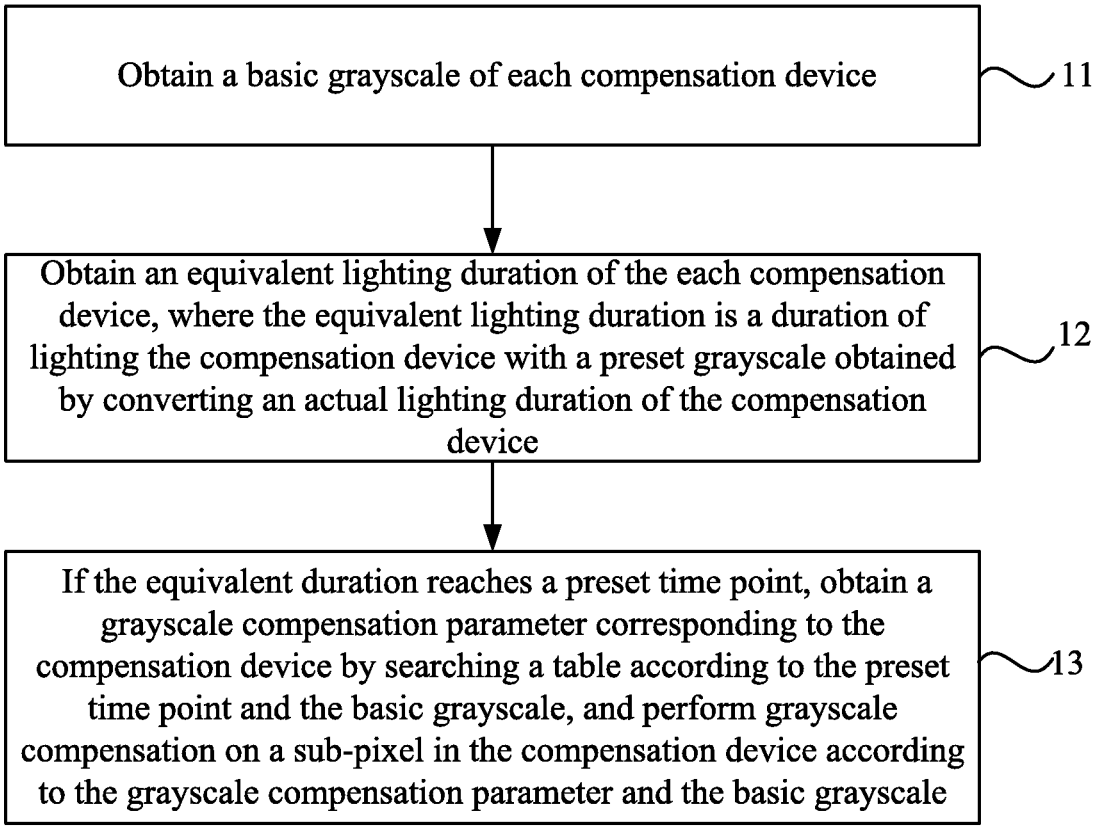
FIG. 1 is a schematic flowchart of a grayscale compensation method according to an embodiment of the present disclosure.

Embodiments of the present disclosure to achieve the intended purpose of the present disclosure, the implementation, structure, characteristics, and effects of a grayscale compensation method and apparatus, display device according to the present disclosure are described in detail below with reference to the drawings and embodiments.

An embodiment of the present disclosure provides a grayscale compensation method, and the method includes following steps.

A basic grayscale of each compensation device is obtained.

An equivalent lighting duration of the each compensation device is obtained, where the equivalent lighting duration is a duration of lighting the compensation device with a preset grayscale obtained by converting an actual lighting duration of the compensation device.

If the equivalent duration reaches a preset time point, a grayscale compensation parameter corresponding to the compensation device is obtained by searching a table according to the preset time point and the basic grayscale, and grayscale compensation is performed on a sub-pixel in the compensation device according to the grayscale compensation parameter and the basic grayscale.

The compensation device includes one sub-pixel, and the basic grayscale is a current grayscale of the sub-pixel.

Or the compensation device includes multiple sub-pixels with a same light-emitting color in a preset partition, and the basic grayscale is an average value of current grayscales of the multiple sub-pixels with the same light-emitting color.

According to the embodiment of the present disclosure, when the equivalent lighting duration of the compensation device reaches any preset time point, a grayscale compensation parameter corresponding to the compensation device is obtained by searching a table according to the preset time point and the basic grayscale, and grayscale compensation is performed on a sub-pixel in the compensation device according to the grayscale compensation parameter and the basic grayscale, which realize targeted compensation for each compensation device and real time compensation for the corresponding compensation device after the grayscale of each compensation device has decayed to a certain degree, that is, the compensation device is independently timed and independently compensated. The compensation parameters used in the grayscale compensation process of the compensation device are obtained based on the independent timing of the corresponding compensation device. The compensation accuracy is high, and no over-compensation phenomenon occurs. Therefore, there is no need to solve the over-compensation after the grayscale compensation operation, which helps to simplify the grayscale compensation process.

In the following description, many details are set forth in order to fully understand the present disclosure, but the present disclosure can also be implemented by other embodiments different from those described herein, and make a similar promotion without violating the connotation of the present disclosure, so the present disclosure is not limited by the embodiments disclosed below.

Secondly, the present disclosure is described in detail with reference to the schematic diagrams. In the detailed description of the present disclosure, for the convenience of explanation, the schematic diagrams showing the structure of the device are not partially enlarged according to general proportions, and the schematic diagrams are merely examples, which should not limit the scope of protection of the present disclosure. In addition, the actual production should include three-dimensional space dimensions of length, width and height.

FIG. 1 is a schematic flowchart of a grayscale compensation method according to an embodiment of the present disclosure. As shown in FIG. 1, the grayscale compensation method may include following steps.

In step 11, a basic grayscale of each compensation device is obtained, where the compensation device includes a sub-pixel, and the basic grayscale is the current grayscale of the sub-pixel, or the compensation device includes multiple sub-pixels with a same light-emitting color in a preset partition, and the basic grayscale is an average value of current grayscales of the multiple sub-pixels with the same light-emitting color, the basic grayscale(s) of sub-pixel(s) included in each compensation device corresponds to the grayscale(s) of the sub-pixel(s) of an image which is being currently displayed in need.

Figure 2:
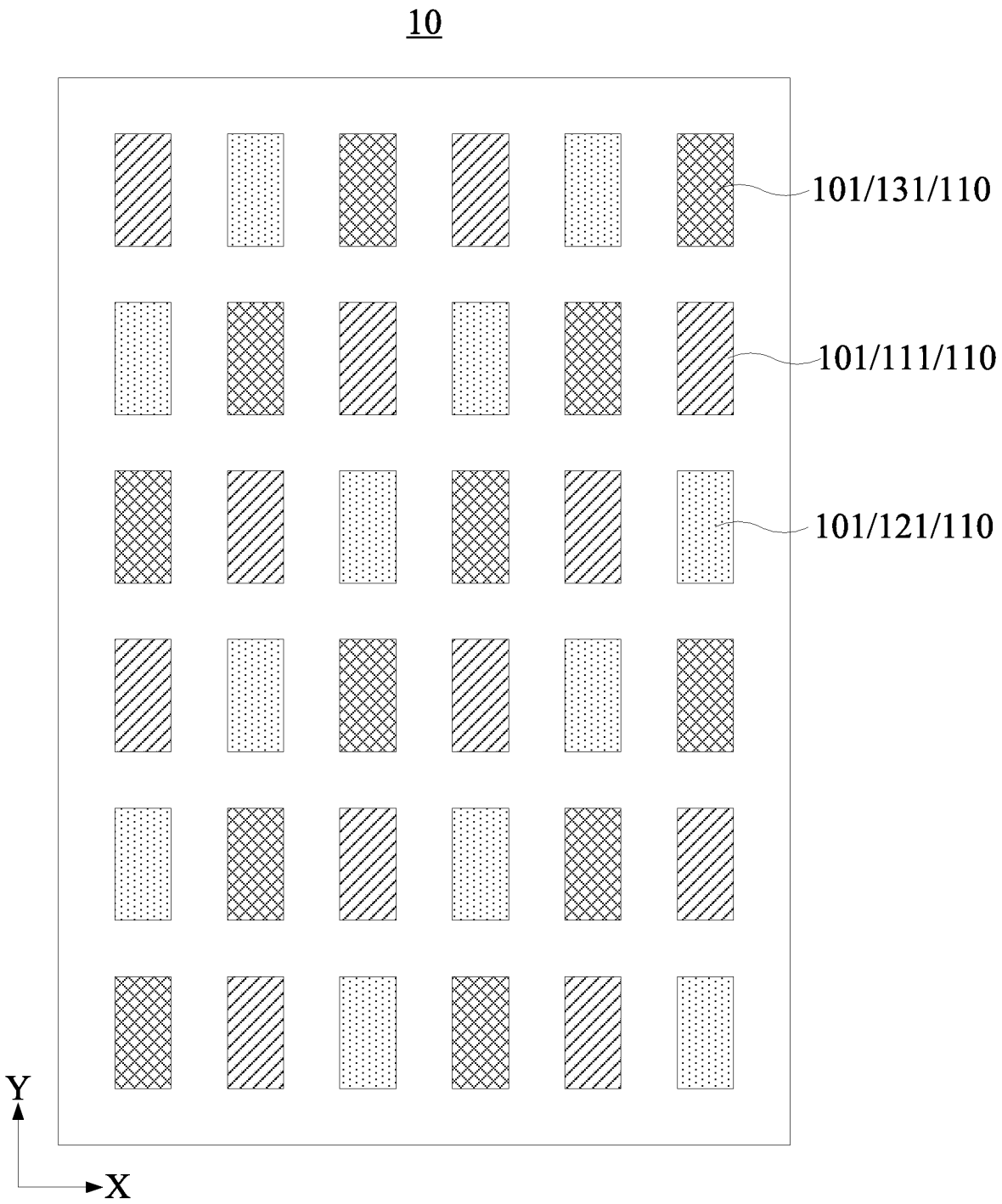
FIG. 2 is a schematic structural diagram of a display panel according to an embodiment of the present disclosure.
Figure 3:
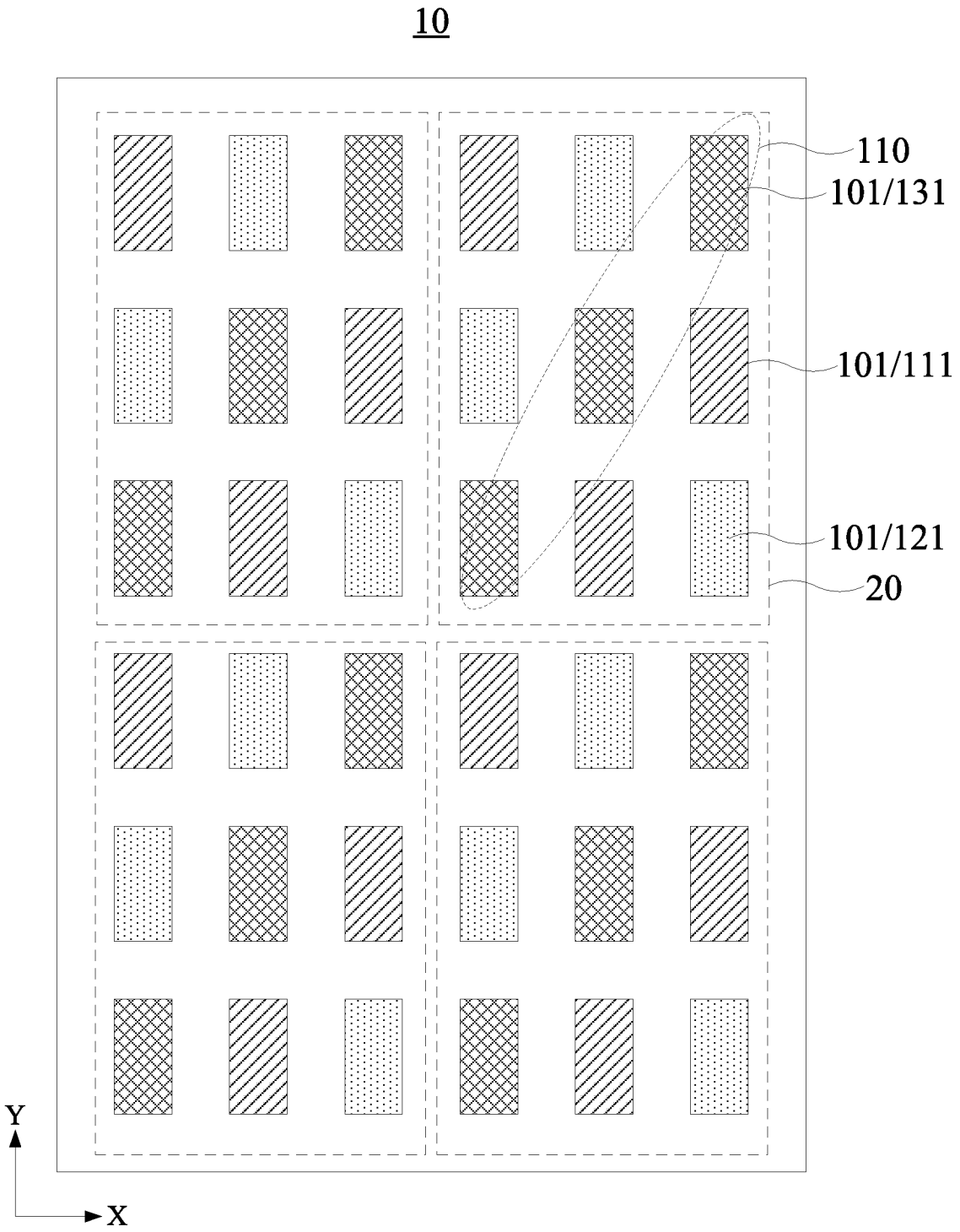
FIG. 3 is a schematic structural diagram of another display panel according to an embodiment of the present disclosure.

FIG. 2 is a schematic structural diagram of a display panel according to an embodiment of the present disclosure. FIG. 3 is a schematic structural diagram of another display panel according to an embodiment of the present disclosure. As shown in FIGS. 2 and 3, a display panel 10 includes multiple sub-pixels 101 arranged in a matrix. The multiple sub-pixels 101 includes multiple first sub-pixels 111, multiple second sub-pixels 121, and multiple third sub-pixels 131; the first sub-pixels 111, the second sub-pixels 121, and the third sub-pixels 131 have different light-emitting colors; and along each of the row direction X and column direction Y of the matrix, the first sub-pixels 111, the second sub-pixels 121, and the third sub-pixels 131 are all arranged by turns. In one or more embodiments, as shown in FIG. 2, each sub-pixel 101 may be used as a compensation device 110; or, as shown in FIG. 3, the display panel 10 is divided into multiple partitions 20, and multiple sub-pixels 101 with a same light-emitting color in each partition 20 serve as one compensation device 110. It can be understood that the setting manner of the compensation device 110 may be reasonably selected according to actual needs, which is not limited in the embodiment.

It should be noted that the grayscale of the compensation device 110 is obtained in real time, and the current grayscale here refers to the current grayscale of the compensation device 110 at any compensation moment.

In step 12, an equivalent lighting duration of the each compensation device is obtained, where the equivalent lighting duration is a duration of lighting the compensation device with a preset grayscale obtained by converting an actual lighting duration of the compensation device.

It can be understood that the equivalent lighting duration is the equivalent duration of the actual lighting duration of the compensation device. In one or more embodiments, the preset grayscale may be the maximum grayscale value within an effective grayscale interval. The range of the effective grayscale interval is not limited in the embodiment. The designer may determine a proper effective grayscale interval according to actual needs. In one embodiment, the effective grayscale interval may be grayscales from 0 to 255. Correspondingly, the maximum grayscale value in the effective grayscale interval is grayscale 255.

It should be noted that grayscale 255 is the maximum grayscale of the commonly used effective grayscale region from grayscale 0 to grayscale 255. It can be understood that compared with other grayscales, the grayscale attenuation speed of the sub-pixel is the largest when lighting by using the 255 grayscale. Furthermore, when the grayscale 255 is used as a preset grayscale, the value of the equivalent lighting duration obtained from the actual lighting duration of the sub-pixel is small, which helps to simplify the storage of time data and reduce the computing difficulty of time data.

It should also be noted that after a thin film transistor and a light-emitting element corresponding to the compensation device age to a certain degree, the grayscale attenuation of the compensation device may be perceived by human eyes, which will cause attenuation of the brightness of the display panel to decay and impact on the display effect. Therefore, in the embodiment, grayscale compensation is performed on the compensation device when the thin film transistor and the light-emitting element corresponding to each compensation device age to the above level. Specifically, a grayscale attenuation amount of the compensation device is related to a display grayscale and display duration of the compensation device, but sub-pixels for a same displayed image have different display grayscales, and a same sub-pixel for different display images also have different display grayscales. Therefore, it is impossible to determine whether the grayscale attenuation of each compensation device reaches a level that can be perceived by the human eye based on only the actual display duration of the compensation device. The compensation process often requires complex IC algorithms to support and the cost is high. Based on the above reasons, in the embodiment, the actual display duration of each compensation device is converted to a duration for the compensation device to be lighted with a preset grayscale, to directly determine whether the grayscale attenuation of the compensation device reaches a level that may be perceived by the human eyes based on the duration.

Exemplarily, each sub-pixel is a compensation device, and any compensation device is selected as a target compensation device. The target compensation device includes a first display stage and a second display stage. The display parameters of the first display stage are: grayscale 111, displaying for 5 minutes, that is, the display parameters are grayscale 111 and 5 minute; and the display parameters of the second display phase are: grayscale 222, displaying for 10 minutes, that is, the display parameters are grayscale 222 and 10 minutes. A default grayscale is set to grayscale 255, a time conversion coefficient between a display duration with grayscale 111 and a display duration with grayscale 255 is a, and a time conversion coefficient between a display duration with grayscale 222 and a display duration with grayscale 255 is b, then the actual display duration of the target compensation device is (5+10)=15 minutes, and the equivalent duration of the target compensation device obtained by conversion is (5a+10b) minutes.

In step 13, if the equivalent duration reaches a preset time point, a grayscale compensation parameter corresponding to the compensation device is obtained by searching a table according to the preset time point and the basic grayscale, and grayscale compensation is performed on a sub-pixel in the compensation device according to the grayscale compensation parameter and the basic grayscale.

It should be noted that the number of preset time points is multiple. Specifically, each preset time point is obtained from experimental data before the compensation operation.

It should also be noted that each grayscale compensation device is independently timed. For each compensation device, each time the equivalent duration is determined to reach a preset time point, a table is searched to obtain the corresponding grayscale compensation parameters to perform grayscale compensation once on the grayscale of the sub-pixels included in the compensation device. Compensation methods will be described later in detail.

In addition, the grayscale compensation parameters are obtained by searching the table, searching the table refers to searching a compensation data table. The data in the compensation data table includes multiple preset time points Tn, multiple grayscale values Hm, and grayscale compensation parameters Qp corresponding to different preset time points Tn and grayscale values Hm. As shown in FIG. 4, the grayscale value Hm is the basic grayscale of the compensation device, that is, the current grayscale of the compensation device at a corresponding preset time point Tn. After the preset time point Tn and the grayscale value Hm are determined, the corresponding grayscale compensation parameter Qp may be obtained by searching the table. It is worth noting that when the compensation device includes multiple sub-pixels, the grayscale value Hm is the average grayscale value of multiple sub-pixels in the compensation device, and the corresponding compensation parameters are used to compensate the grayscales of all sub-pixels in the compensation device.

It may be understood that the grayscale attenuation of sub-pixels is different for each light-emitting color. Therefore, each sub-pixel of a light-emitting color corresponds to a compensation data table. Exemplarily, the display panel in FIG. 2 and FIG. 3 includes sub-pixels 101 of three different light-emitting colors corresponding to three compensation data tables. In one embodiment, the three sub-pixels with different light-emitting colors are red sub-pixel, green sub-pixel and blue sub-pixel respectively, and correspond to the compensation data tables shown in FIG. 5, FIG. 6, and FIG. 7 respectively.

According to the embodiment, when the equivalent lighting duration of the compensation device reaches any preset time point, a grayscale compensation parameter corresponding to the compensation device is obtained by searching a table according to the preset time point and the basic grayscale, and grayscale compensation is performed on a sub-pixel in the compensation device according to the grayscale compensation parameter and the basic grayscale, which realize targeted compensation for each compensation device, obtaining the equivalent lighting duration of the compensation device in real time, and compensation for the corresponding compensation device after the grayscale of each compensation device has decayed to a certain degree, that is, the compensation device is independently timed and independently compensated. The compensation parameters used in the grayscale compensation process of the compensation device are obtained based on the independent timing of the corresponding compensation device. The compensation accuracy is high, and no over-compensation phenomenon occurs. Therefore, there is no need to solve the over-compensation after the grayscale compensation operation, which helps to simplify the grayscale compensation process.

Figure 8:
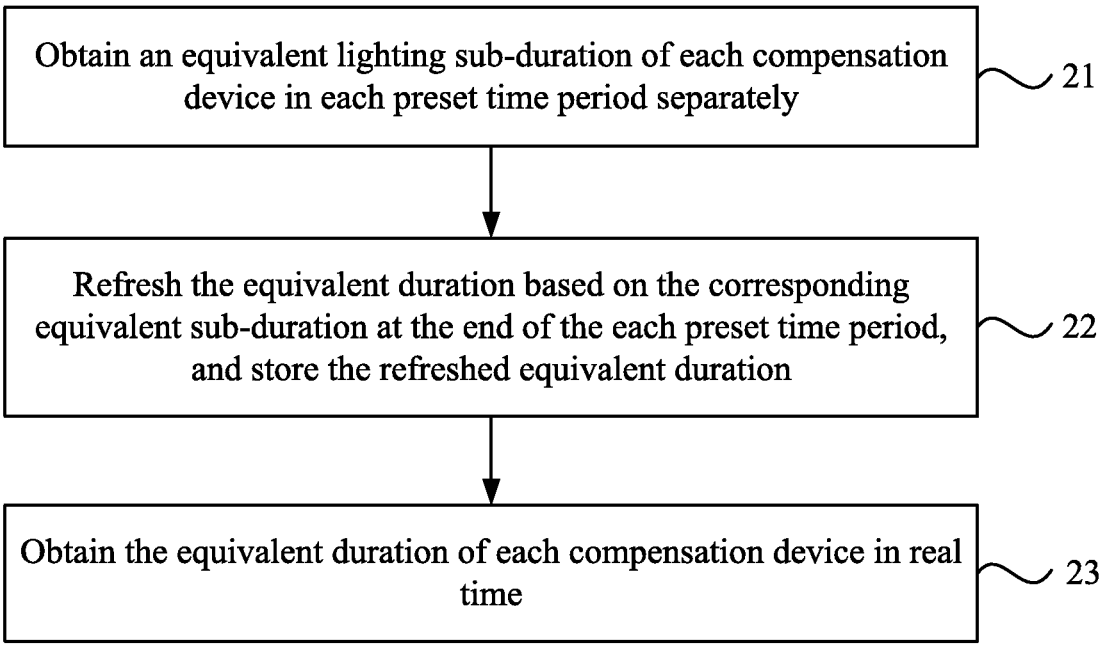
FIG. 8 is a schematic flowchart of obtaining an equivalent lighting duration of each compensation device according to an embodiment of the present disclosure.

Exemplarily, FIG. 8 is a schematic flowchart of obtaining an equivalent lighting duration of each compensation device according to an embodiment of the present disclosure. As shown in FIG. 8, the obtaining of the equivalent lighting duration of each compensation device may include the following steps.

In step 21, an equivalent lighting sub-duration of each compensation device in each preset time period is obtained separately, where the equivalent lighting sub-duration is a duration of lighting the compensation device with a preset grayscale obtained by converting an lighting duration of the compensation device in the each preset time period corresponding to the equivalent lighting sub-duration.

It should be noted that the display image is displayed in devices of frames. In one or more embodiments, the preset time period may include an integer number of frame durations.

In step 22, the equivalent duration is refreshed based on the corresponding equivalent lighting sub-duration at the end of the each preset time period, and the refreshed equivalent duration is stored.

Exemplarily, the equivalent duration of each compensation device may be stored in a corresponding storage device. Specifically, the lower 6 bits of the storage device are used to store minutes and the higher 15 bits are used to store hours.

In step 23, the equivalent duration of each compensation device is obtained in real time.

It should be noted that the equivalent duration is not updated in real time, but every preset time period, to reduce the update frequency of the equivalent duration and reduce the occupation of the program process by the operation of updating the equivalent duration, which is beneficial to the simplification of the compensation process.

Furthermore, the separate obtaining of an equivalent lighting sub-duration of each compensation device in each preset time period includes: in the each preset time period, a frame lighting equivalent duration of the each compensation device in each frame as is separately accumulated an equivalent lighting sub-duration corresponding to the compensation device; where the frame lighting equivalent duration is a duration of lighting the compensation device with a preset grayscale obtained by converting an lighting duration of the compensation device in the each frame corresponding to the frame lighting equivalent duration.

It should be noted that the grayscale of the same compensation device in different display images are different, and the sub-pixels with the same light emission color but different grayscales have different time conversion parameters. Therefore, in order to make the equivalent duration obtained by converting the actual display duration more accurate, in the embodiment, after each frame is displayed, the actual lighting duration of each compensation device in the frame is converted to the corresponding frame lighting equivalent duration, and the frame lighting equivalent duration of each compensation device is accumulated to obtain the corresponding equivalent lighting sub-duration of each compensation device.

Figure 9:
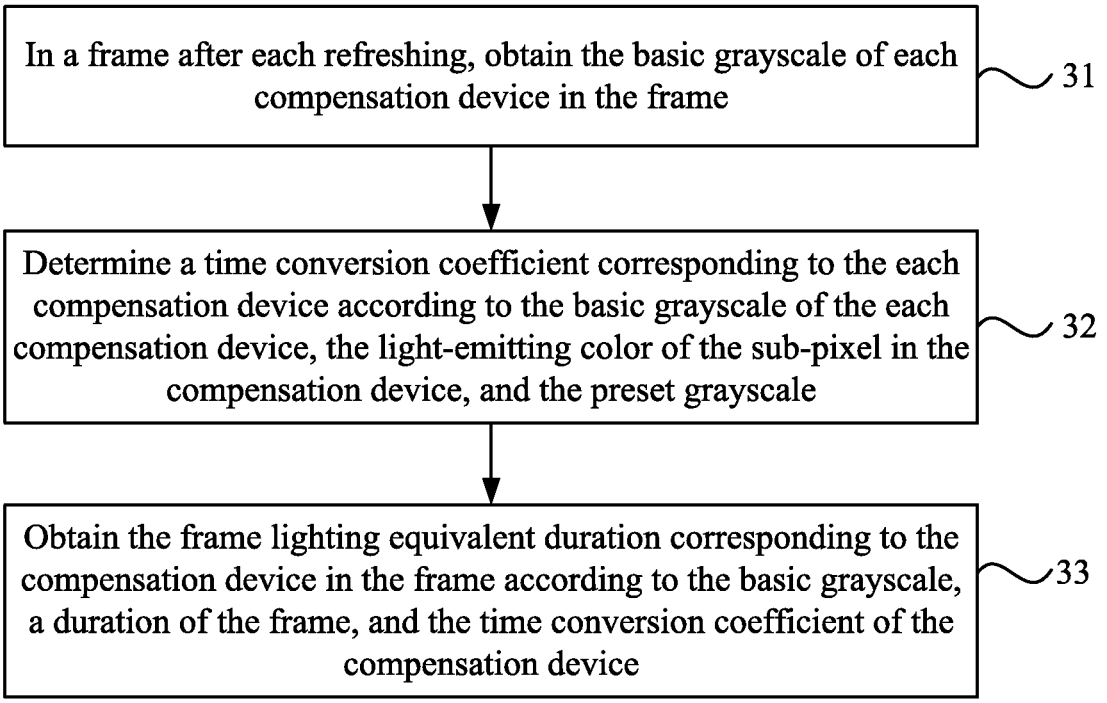
FIG. 9 is a schematic flowchart of accumulating frame lighting equivalent duration of each compensation device in each frame according to an embodiment of the present disclosure.

In an embodiment, FIG. 9 is a schematic flowchart of accumulating frame lighting equivalent duration of each compensation device in each frame according to an embodiment of the present disclosure. As shown in FIG. 9, the accumulation of the frame lighting equivalent duration of each compensation device in each frame may include following steps.

In step 31, in a frame after each refreshing, the basic grayscale of the each compensation device in the frame is obtained.

In step 32, a time conversion coefficient corresponding to the each compensation device is determined according to the basic grayscale of the each compensation device, the light-emitting color of the sub-pixel in the compensation device, and the preset grayscale.

In step 33, the frame lighting equivalent duration of the corresponding compensation device in the frame is obtained according to the basic grayscale, a duration of the frame, and the time conversion coefficient of the compensation device.

Exemplarily, the preset time period is the total display duration of 3 frames, each sub-pixel is a compensation device, and any compensation device is taken as the target compensation device. Display grayscales of the target compensation device in the 3 frames are 111, 222 and 234 respectively, a time conversion coefficient between the display duration of grayscale 111 and grayscale 255 is a, a time conversion coefficient between the display duration of grayscale 222 and grayscale 255 is b, a time conversion coefficient between the display duration of grayscale 333 and grayscale 255 is c, and the actual display duration of the target compensation device in each of the 3 frames is 2 seconds, then the frame lighting equivalent duration of the target compensation device in the 3 frames are 2a, 2b and 2c respectively, and the equivalent lighting sub-duration of the compensation device is equal to (2a+2b+2c) seconds.

It should be noted that the time conversion coefficient is known data which is obtained experimentally before the grayscale compensation. The time conversion coefficient is related to the light-emitting color, the basic grayscale and the preset grayscale of the corresponding compensation device, and is determined by the three above. Therefore, after they are determined, the corresponding time conversion coefficient may be obtained.

In one or more embodiments, the value range of the preset time period may be 30 minutes to 90 minutes. It should be noted that, if the preset time period is too short, the equivalent duration is updated frequently, and the occupation of the program process by the equivalent duration updating operation cannot be reduced well; if the preset period is too large, the phenomenon of skipping the preset time point occurs, and grayscale compensation cannot be accurate. Experiments show that when the preset time period is set between 30 minutes to 90 minutes, the equivalent duration is updated at a moderate frequency, and the phenomenon of skipping a preset time point will not occur.

Exemplarily, the grayscale compensation parameter may be a grayscale value, so that the measurement devices of the grayscale compensation parameter and the basic grayscale of the compensation device are the same, and the calculation is convenient to be carried out based on the grayscale compensation parameter and the basic grayscale of the compensation device.

On the basis of the above, the grayscale compensation on the sub-pixels in the compensation device according to the grayscale compensation parameter and the basic grayscale includes: taking the sum of the grayscale compensation parameter and the basic grayscale as the grayscale value after each sub-pixel in the compensation device is compensated.

It should be noted that such a setting makes it possible to obtain the compensated grayscale value through the grayscale summation method, which simplifies the compensation calculation process.

In one or more embodiments, before the obtaining of the basic grayscale of each compensation device, the method further includes: establishing a compensation data table to form a basis for obtaining parameters in the compensation process.

Figure 10:
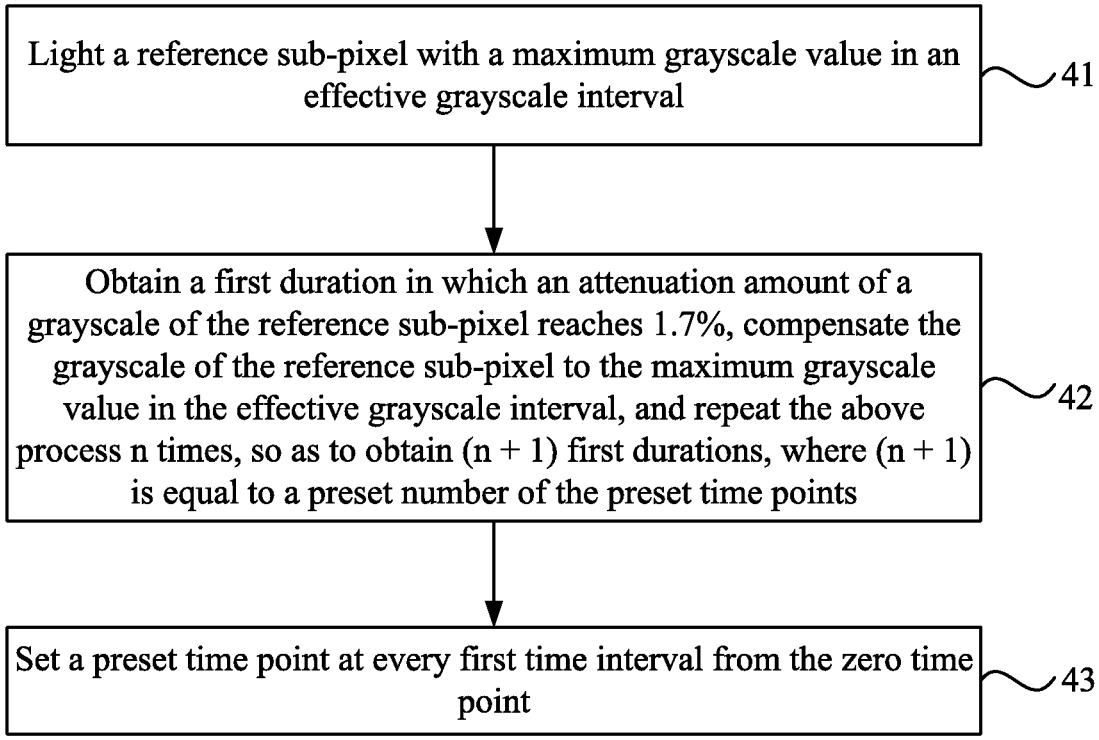
FIG. 10 is a schematic flowchart of establishing a compensation data table according to an embodiment of the present disclosure.

Exemplarily, FIG. 10 is a schematic flowchart of establishing a compensation data table according to an embodiment of the present disclosure. As shown in FIG. 10, the establishment of the compensation data table may include following steps.

In step 41, a reference sub-pixel is lighted with a maximum grayscale value in an effective grayscale interval.

The reference sub-pixel is a sub-pixel in a display panel in an experiment set to determine multiple preset time points. Exemplarily, the maximum grayscale value in the effective grayscale interval may be grayscale 255. Correspondingly, the reference sub-pixel is lighted at grayscale 255.

In step 42, a first duration in which an attenuation amount of a grayscale of the reference sub-pixel reaches 1.7% is obtained, the grayscale of the reference sub-pixel is compensated to the maximum grayscale value in the effective grayscale interval; and the above process is repeated n times, (n+1) first durations are obtained, where (n+1) is equal to a preset number of the preset time points.

In one or more embodiments, the preset number of preset time points may be reasonably set according to actual needs and used to determine the number of preset time points in the compensation data table. It can be understood that with the increase of the lighting duration, the aging of the thin-film transistor and the light-emitting element in the reference sub-pixel gradually increases. Therefore, after each compensation and following 1.7% attenuation, the grayscale of the reference sub-pixel is not exactly the same. In order to make the compensation operation corresponding to the preset time point in the compensation data table more accurate, the method in step 42 is used to determine the first duration between adjacent preset time points.

In step 43, a preset time point is set at intervals of first duration from the zero time point.

The zero time point is the time point when the reference sub-pixel starts to be lighted.

Figure 11:
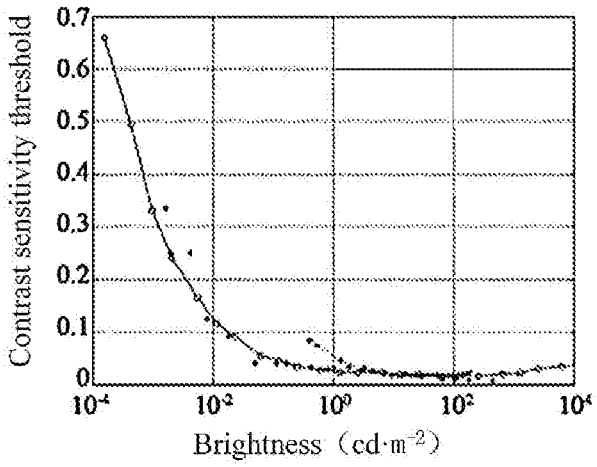
FIG. 11 is a schematic diagram of a relationship between a contrast sensitivity threshold and a background brightness according to an embodiment of the present disclosure.

It should be noted that, as described above, after the thin film transistor and the light-emitting element corresponding to the compensation device age to a certain degree, the grayscale attenuation amount of the compensation device may be perceived by human eyes. Therefore, in the embodiment, grayscale compensation is performed on the compensation device when the thin film transistor and the light emitting element corresponding to each compensation device age to the above-mentioned level. FIG. 11 is a schematic diagram of a relationship between a contrast sensitivity threshold and a background brightness according to an embodiment of the present disclosure. Specifically, the contrast sensitivity threshold is a ratio of the minimum perceptible difference of the human eyes to corresponding brightness. As shown in FIG. 11, when the brightness is greater than 1, the contrast sensitivity threshold is basically maintained at about 0.017. Therefore, exemplarily, taking the maximum grayscale in the effective grayscale interval is grayscale 255 as an example, when a sub-pixel with the grayscale 255 has grayscale attenuation of 1.7%, the grayscale attenuation of the sub-pixel reaches the minimum grayscale difference of the sub-pixel that can be perceived by the human eyes. Therefore, the preset time points (T1 . . . Tn) are determined on the basis of this to ensure that when the grayscale compensation operation of the compensation device is performed at the pre-set time points, the human eyes cannot detect the abnormality of the grayscale of the sub-pixel, and good visual image is guaranteed.

Figure 12:
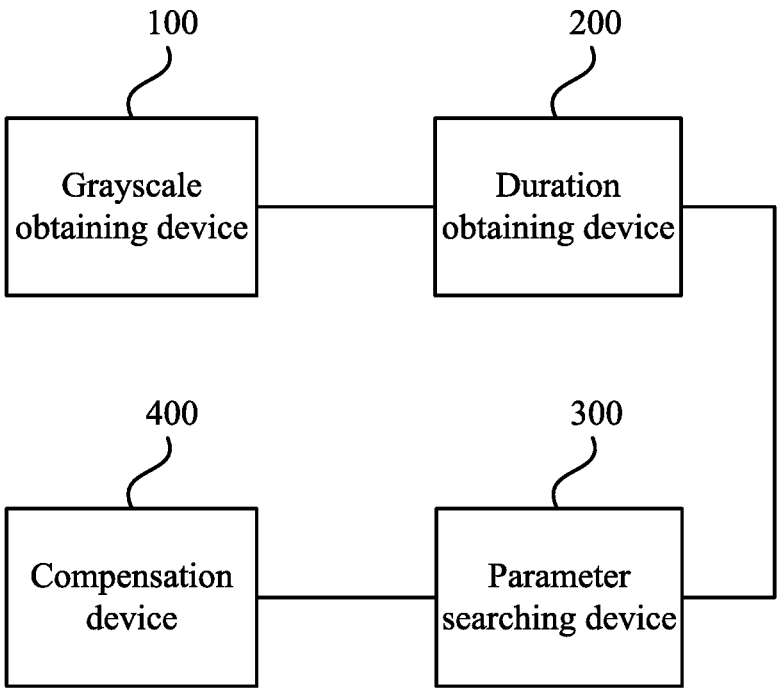
FIG. 12 is a schematic structural diagram of a grayscale compensation apparatus according to an embodiment of the present disclosure.

FIG. 12 is a schematic structural diagram of a grayscale compensation apparatus according to an embodiment of the present disclosure. As shown in FIG. 12, the grayscale compensation apparatus includes a grayscale obtaining device 100, a duration obtaining device 200, a parameter searching device 300 and a compensation device 400.

The grayscale obtaining device 100 is configured to acquire a basic grayscale of each compensation device, where the compensation device includes a sub-pixel, and the basic grayscale is the current grayscale of the sub-pixel, or the compensation device includes multiple sub-pixels with a same light-emitting color in a preset partition, and the basic grayscale is an average value of current grayscales of the multiple sub-pixels with the same light-emitting color.

The duration obtaining device 200 is configured to acquire an equivalent lighting duration of the each compensation device, where the equivalent lighting duration is a duration of lighting the compensation device with a preset grayscale obtained by converting an actual lighting duration of the compensation device.

The parameter searching device 300 is configured to, in response to determining that the equivalent duration reaches a preset time point, acquire a grayscale compensation parameter corresponding to the compensation device by searching a table according to the preset time point and the basic grayscale.

The compensation device 400 is configured to perform grayscale compensation on a sub-pixel in the compensation device according to the grayscale compensation parameter and the basic grayscale.

Figure 13:
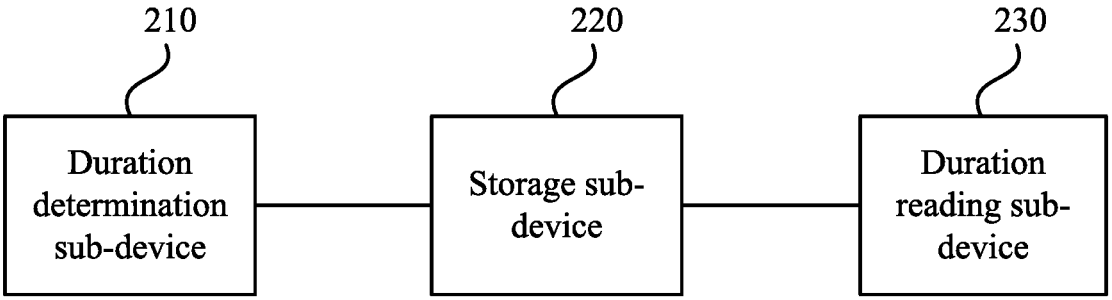
FIG. 13 is a schematic structure diagram of a duration obtaining device according to an embodiment of the present disclosure.

FIG. 13 is a schematic structure diagram of a duration obtaining device according to an embodiment of the present disclosure. As shown in FIG. 13, the duration obtaining device includes a duration determination sub-device 210, a storage sub-device 220 and a duration reading sub-device 230.

The duration determination sub-device 210 is configured to acquire an equivalent lighting sub-duration of the each compensation device in each preset time period separately, where the equivalent lighting sub-duration is a duration of lighting the compensation device with a preset grayscale obtained by converting an lighting duration of the compensation device in the each preset time period corresponding to the equivalent lighting sub-duration.

The storage sub-device 220 is configured to refresh the equivalent duration based on the corresponding equivalent lighting sub-duration at the end of the each preset time period, and the refreshed equivalent duration is stored.

The duration reading sub-device 230 is configured to acquire the equivalent duration of the each compensation device in real time.

Figure 14:
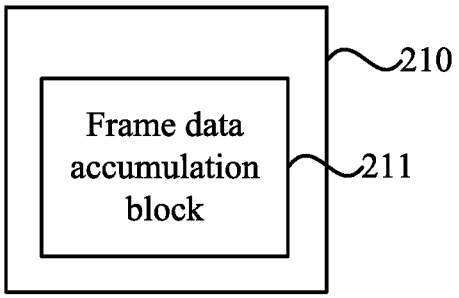
FIG. 14 is a schematic structural diagram of a duration determination subdevice according to an embodiment of the present disclosure; FIG.

FIG. 14 is a schematic structural diagram of a duration determination subdevice according to an embodiment of the present disclosure. As shown in FIG. 14, the duration determination sub-device 210 includes a frame data accumulation block 211.

The frame data accumulation block 211 is configured to, in the each preset time period, separately accumulate a frame lighting equivalent duration of the each compensation device in each frame as the equivalent lighting sub-duration corresponding to the compensation device; where the frame lighting equivalent duration is a duration of lighting the compensation device with a preset grayscale obtained by converting an lighting duration of the compensation device in the each frame corresponding to the frame lighting equivalent duration.

Figure 15:
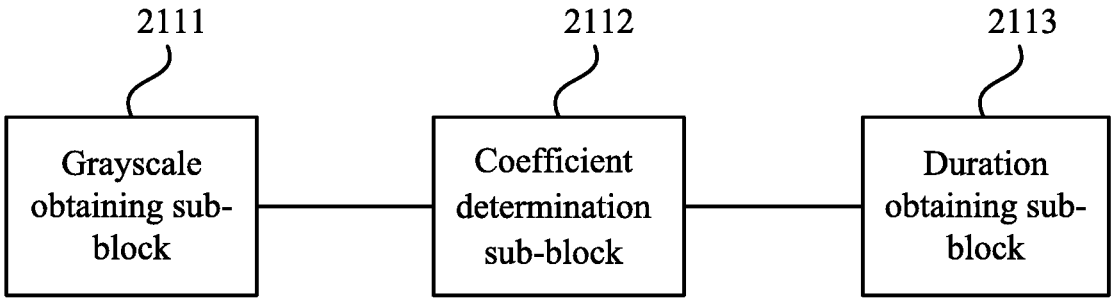
FIG. 15 is a schematic structure diagram of a frame data accumulation block according to an embodiment of the present disclosure.

FIG. 15 is a schematic structure diagram of a frame data accumulation block according to an embodiment of the present disclosure. As shown in FIG. 15, the frame data accumulation block includes a grayscale obtaining sub-block 2111, a coefficient determination sub-block 2112 and a duration obtaining sub-block 2113.

The grayscale obtaining sub-block 2111 is configured to, in a frame after each refreshing, acquire the basic grayscale of each compensation device in the frame.

The coefficient determination sub-block 2112 is configured to determine a time conversion coefficient corresponding to each compensation device according to the basic grayscale of the each compensation device, the light-emitting color of the sub-pixel in the compensation device, and the preset grayscale.

The duration obtaining sub-block 2113 is configured to obtain the frame lighting equivalent duration corresponding to the compensation device in the frame according to the basic grayscale, a duration of the frame, and the time conversion coefficient of the compensation device.

Exemplarily, the grayscale compensation parameter is a grayscale value.

The compensation device 400 is configured to use a sum of the grayscale compensation parameter and the basic grayscale as a grayscale value of each sub-pixel after the compensation in the compensation device.

Figure 16:
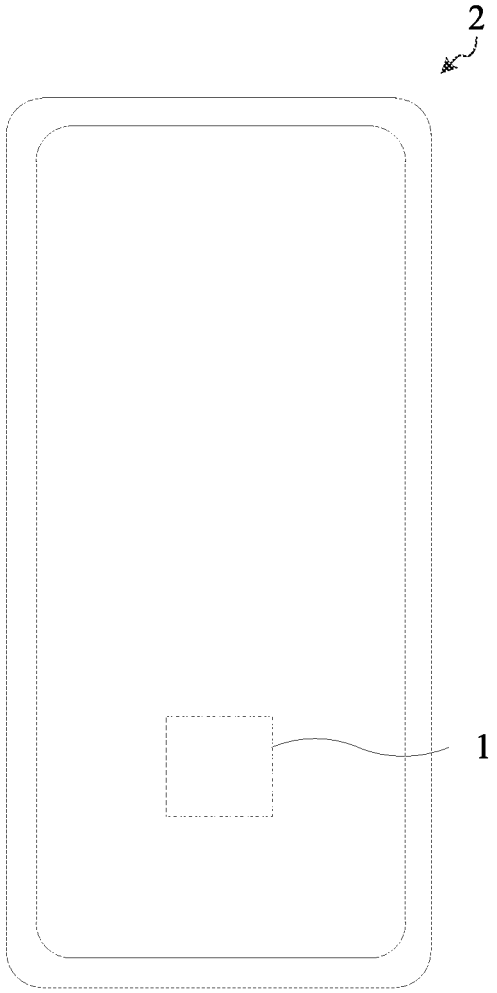
FIG. 16 is a schematic structure diagram of a display device according to an embodiment of the present disclosure.

FIG. 16 is a schematic structure diagram of a display device according to an embodiment of the present disclosure. As shown in FIG. 16, the display device 2 includes the grayscale compensation apparatus 1 provided by any embodiment of the present disclosure. Since the display device includes the grayscale compensation apparatus 1 according to any embodiment of the present disclosure, the display device provided by the embodiment of the present disclosure.

It is to be noted that, the various devices, devices, sub-devices and blocks described in the embodiments are realized in the form of circuits. In one or more embodiments, each device, device, sub-device or block may be implemented by a separate circuit. In one or more embodiments, any combination of these devices, devices, sub-devices and blocks may be implemented in a same circuit. The circuit for implementing the devices, devices, sub-devices and blocks may be a logic circuit configured inside an integrated circuit or separate from the integrated circuit.

What is claimed is:

1. A grayscale compensation method, comprising:

obtaining a basic grayscale of each compensation device;

obtaining an equivalent lighting duration of the each compensation device, wherein the equivalent lighting duration is a duration of lighting the compensation device with a preset grayscale obtained by converting an actual lighting duration of the compensation device;

in response to determining that an equivalent duration reaches a preset time point, obtaining a grayscale compensation parameter corresponding to the compensation device by searching a table according to the preset time point and the basic grayscale, and performing grayscale compensation on a sub-pixel in the compensation device according to the grayscale compensation parameter and the basic grayscale; and wherein the compensation device comprises one sub-pixel, and the basic grayscale is a current grayscale of the sub-pixel; or the compensation device comprises a plurality of sub-pixels with a same light-emitting color in a preset partition, and the basic grayscale is an average value of current grayscales of the plurality of sub-pixels with the same light-emitting color.

2. The grayscale compensation method of claim 1, wherein obtaining the equivalent lighting duration of the each compensation device comprises:

obtaining an equivalent lighting sub-duration of the each compensation device in each preset time period separately, wherein the equivalent lighting sub-duration is a duration of lighting the compensation device with a preset grayscale obtained by converting an lighting duration of the compensation device in each preset time period corresponding to the equivalent lighting sub-duration;

refreshing the equivalent duration based on the corresponding equivalent lighting sub-duration at the end of each preset time period, and storing the refreshed equivalent duration; and obtaining the equivalent duration of the each compensation device in real time.

3. The grayscale compensation method of claim 2, wherein the obtaining the equivalent lighting sub-duration of the each compensation device in the each preset time period separately comprises:

in the each preset time period, separately accumulating a frame lighting equivalent duration of the each compensation device in each frame as the equivalent lighting sub-duration corresponding to the compensation device; wherein the frame lighting equivalent duration is a duration of lighting the compensation device with a preset grayscale obtained by converting an lighting duration of the compensation device in the each frame corresponding to the frame lighting equivalent duration.

4. The grayscale compensation method of claim 3, wherein separately accumulating the frame lighting equivalent duration of the each compensation device in the each frame comprises:

in a frame after each refreshing, obtaining the basic grayscale of the each compensation device in the frame;

determining a time conversion coefficient corresponding to the each compensation device according to the basic grayscale of the each compensation device, the light-emitting color of the sub-pixel in the compensation device, and the preset grayscale; and obtaining the frame lighting equivalent duration corresponding to the compensation device in the frame according to the basic grayscale, a duration of the frame, and the time conversion coefficient of the compensation device.

5. The grayscale compensation method of claim 1, wherein the preset grayscale has a maximum grayscale value within an effective grayscale interval.

6. The grayscale compensation method of claim 2, wherein the preset time period has a value range of 30 minutes to 90 minutes.

7. The grayscale compensation method of claim 1, wherein the grayscale compensation parameter is a grayscale value.

8. The grayscale compensation method of claim 7, wherein performing grayscale compensation on the sub-pixel in the compensation device according to the grayscale compensation parameter and the basic grayscale comprises:

using a sum of the grayscale compensation parameter and the basic grayscale as a grayscale value of each sub-pixel after the compensation in the compensation device.

9. The grayscale compensation method of claim 1, wherein before obtaining the basic grayscale of the each compensation device, the method further comprises:

creating a compensation data table;

wherein creating the compensation data table comprises:

lighting a reference sub-pixel with a maximum grayscale value in an effective grayscale interval;

obtaining a first duration in which an attenuation amount of a grayscale of the reference sub-pixel reaches 1.7%, compensating the grayscale of the reference sub-pixel to the maximum grayscale value in the effective grayscale interval; repeating the above process n times to obtain a number (n+1) of first durations, wherein (n+1) is equal to a preset number of the preset time point; and setting the preset number of the preset time point at intervals of the (n+1) first durations from time zero.

10. A grayscale compensation apparatus, comprising:

a grayscale obtaining device, which is configured to obtain a basic grayscale of each compensation device;

a duration obtaining device, which is configured to obtain an equivalent lighting duration of the each compensation device, wherein the equivalent lighting duration is a duration of lighting the compensation device with a preset grayscale obtained by converting an actual lighting duration of the compensation device;

a parameter searching device, which is configured to, in response to determining that the equivalent duration reaches a preset time point, obtain a grayscale compensation parameter corresponding to the compensation device by searching a table according to the preset time point and the basic grayscale;

a compensation device, which is configured to perform grayscale compensation on a sub-pixel in the compensation device according to the grayscale compensation parameter and the basic grayscale;

wherein the compensation device comprises one sub-pixel, and the basic grayscale is a current grayscale of the sub-pixel; or the compensation device comprises a plurality of sub-pixels with a same light-emitting color in a preset partition, and the basic grayscale is an average value of current grayscales of the plurality of sub-pixels with the same light-emitting color.

11. The grayscale compensation apparatus of claim 10, wherein the duration obtaining device comprises:

a duration determination sub-device, which is configured to obtain an equivalent lighting sub-duration of the each compensation device in each preset time period separately, wherein the equivalent lighting sub-duration is a duration of lighting the compensation device with a preset grayscale obtained by converting an lighting duration of the compensation device in each preset time period corresponding to the equivalent lighting sub-duration;

a storage sub-device, which is configured to refresh the equivalent duration based on the corresponding equivalent lighting sub-duration at the end of each preset time period, and store the refreshed equivalent duration; and a duration reading sub-device, which is configured to obtain the equivalent duration of the each compensation device in real time.

12. The grayscale compensation apparatus of claim 11, wherein the duration determination sub-device comprises:

a frame data accumulation block, which is configured to, in the each preset time period, separately accumulate a frame lighting equivalent duration of the each compensation device in each frame as the equivalent lighting sub-duration corresponding to the compensation device; wherein the frame lighting equivalent duration is a duration of lighting the compensation device with a preset grayscale obtained by converting an lighting duration of the compensation device in the each frame corresponding to the frame lighting equivalent duration.

13. The grayscale compensation apparatus of claim 12, wherein the frame data accumulation block comprises:

a grayscale obtaining sub-block, which is configured to, in a frame after each refreshing, obtain the basic grayscale of the each compensation device in the frame;

a coefficient determination sub-block, which is configured to determine a time conversion coefficient corresponding to the each compensation device according to the basic grayscale of the each compensation device, the light-emitting color of the sub-pixel in the compensation device, and the preset grayscale; and a duration obtaining sub-block, which is configured to obtain the frame lighting equivalent duration corresponding to the compensation device in the frame according to the basic grayscale, a duration of the frame, and the time conversion coefficient of the compensation device.

14. The grayscale compensation apparatus of claim 10, wherein the grayscale compensation parameter is a grayscale value; and the compensation device is configured to use a sum of the grayscale compensation parameter and the basic grayscale as a grayscale value of each sub-pixel after the compensation in the compensation device.

15. A display device, comprising a grayscale compensation apparatus, wherein the apparatus comprises:

a grayscale obtaining device, which is configured to obtain a basic grayscale of each compensation device;

a duration obtaining device, which is configured to obtain an equivalent lighting duration of the each compensation device, wherein the equivalent lighting duration is a duration of lighting the compensation device with a preset grayscale obtained by converting an actual lighting duration of the compensation device;

a parameter searching device, which is configured to, in response to determining that an equivalent duration reaches a preset time point, obtain a grayscale compensation parameter corresponding to the compensation device by searching a table according to the preset time point and the basic grayscale;

a compensation device, which is configured to perform grayscale compensation on a sub-pixel in the compensation device according to the grayscale compensation parameter and the basic grayscale;

wherein the compensation device comprises one sub-pixel, and the basic grayscale is a current grayscale of the sub-pixel; or the compensation device comprises a plurality of sub-pixels with a same light-emitting color in a preset partition, and the basic grayscale is an average value of current grayscales of the plurality of sub-pixels with the same light-emitting color.

16. The grayscale compensation apparatus of claim 15, wherein the duration obtaining device comprises:

a duration determination sub-device, which is configured to obtain an equivalent lighting sub-duration of the each compensation device in each preset time period separately, wherein the equivalent lighting sub-duration is a duration of lighting the compensation device with a preset grayscale obtained by converting an lighting duration of the compensation device in each preset time period corresponding to the equivalent lighting sub-duration;

a storage sub-device, which is configured to refresh the equivalent duration based on the corresponding equivalent lighting sub-duration at the end of each preset time period, and store the refreshed equivalent duration; and a duration reading sub-device, which is configured to obtain the equivalent duration of the each compensation device in real time.

17. The grayscale compensation apparatus of claim 16, wherein the duration determination sub-device comprises:

a frame data accumulation block, which is configured to, in the each preset time period, separately accumulate a frame lighting equivalent duration of the each compensation device in each frame as the equivalent lighting sub-duration corresponding to the compensation device; wherein the frame lighting equivalent duration is a duration of lighting the compensation device with a preset grayscale obtained by converting an lighting duration of the compensation device in the each frame corresponding to the frame lighting equivalent duration.

18. The grayscale compensation apparatus of claim 16, wherein the frame data accumulation block comprises:

a grayscale obtaining sub-block, which is configured to, in a frame after each refreshing, obtain the basic grayscale of the each compensation device in the frame;

a coefficient determination sub-block, which is configured to determine a time conversion coefficient corresponding to the each compensation device according to the basic grayscale of the each compensation device, the light-emitting color of the sub-pixel in the compensation device, and the preset grayscale; and a duration obtaining sub-block, which is configured to obtain the frame lighting equivalent duration corresponding to the compensation device in the frame according to the basic grayscale, a duration of the frame, and the time conversion coefficient of the compensation device.

19. The grayscale compensation apparatus of claim 15, wherein the grayscale compensation parameter is a grayscale value; and the compensation device is configured to use a sum of the grayscale compensation parameter and the basic grayscale as a grayscale value of each sub-pixel after the compensation in the compensation device.

* * * * *